US010506862B2

(12) United States Patent
Villarreal et al.

(10) Patent No.: US 10,506,862 B2
(45) Date of Patent: Dec. 17, 2019

(54) PULL DOWN PUMP ACTUATOR

(71) Applicant: HCT GROUP HOLDINGS LIMITED, Central (CN)

(72) Inventors: Armando Villarreal, Los Angeles, CA (US); Jeremy Wilson, Los Angeles, CA (US); Adrian C. Apodaca, Daly City, CA (US)

(73) Assignee: HCT GROUP HOLDINGS LIMITED (CN)

( * ) Notice: Subject to any disclaimer, the term of this patent is extended or adjusted under 35 U.S.C. 154(b) by 164 days.

(21) Appl. No.: 15/656,274

(22) Filed: Jul. 21, 2017

(65) Prior Publication Data

US 2018/0020807 A1 Jan. 25, 2018

Related U.S. Application Data

(60) Provisional application No. 62/365,502, filed on Jul. 22, 2016.

(51) Int. Cl.
*A46B 11/02* (2006.01)
*A45D 34/04* (2006.01)
(Continued)

(52) U.S. Cl.
CPC ..... *A45D 34/042* (2013.01); *A46B 11/001* (2013.01); *B05B 11/3001* (2013.01);
(Continued)

(58) Field of Classification Search
CPC ..... A45D 34/041; A45D 34/042; A45D 2200/1009; A45D 2200/055; A46B 11/002; A46B 2200/1046; B05B 11/3052
(Continued)

(56) References Cited

U.S. PATENT DOCUMENTS 2,816,308 A 12/1957 Schultz
2,866,993 A 1/1959 Edelstone
(Continued)

FOREIGN PATENT DOCUMENTS

CN 2606543 Y 3/2004
CN 2717278 Y 8/2005
(Continued)

OTHER PUBLICATIONS

International Search Report and Written Opinion dated Nov. 2, 2017 for International Application No. PCT/US2017/043251.

*Primary Examiner* — Jennifer C Chiang
(74) *Attorney, Agent, or Firm* — Seager, Tufte & Wickhem LLP

(57) ABSTRACT

Devices for dispensing and applying a cosmetic product include a container for holding a volume of cosmetic product and a cosmetic dispensing system. The container has a closed end at a lower end of the device and an open end facing an upper end of the device. The cosmetic dispensing system is coupled to the open end of the container and includes a tip having an outlet for dispensing cosmetic product, and an actuator configured to be manually depressed to deliver a portion of the volume of cosmetic product to the outlet. The actuator includes finger guides on opposite sides of the actuator, the finger guides disposed below the tip and providing opposing surfaces for depressing the actuator, moving the actuator towards the lower end of the device.

18 Claims, 8 Drawing Sheets

(51) Int. Cl.
*A46B 11/00* (2006.01)
*B05B 11/00* (2006.01)

(52) U.S. Cl.
CPC ..... *B05B 11/3015* (2013.01); *B05B 11/3052* (2013.01); *A45D 2200/055* (2013.01); *A45D 2200/1009* (2013.01); *A46B 2200/1046* (2013.01); *B05B 11/00416* (2018.08)

(58) Field of Classification Search
USPC ..... 401/188 R
See application file for complete search history.

(56) References Cited

U.S. PATENT DOCUMENTS

| | | | | |
|---|---|---|---|---|
| 3,644,707 | A | 2/1972 | Costello | |
| 3,710,985 | A | 1/1973 | Baum | |
| D235,418 | S | 6/1975 | Petterson | |
| 4,029,422 | A | 6/1977 | Pillsbury | |
| 4,147,284 | A | 4/1979 | Mizzi et al. | |
| 4,454,966 | A | 6/1984 | Hicks | |
| 4,456,155 | A | 6/1984 | Miyata et al. | |
| 4,470,715 | A | 9/1984 | Reuchlin et al. | |
| 4,592,745 | A | 6/1986 | Rex et al. | |
| 4,630,955 | A | 12/1986 | Ladd, Jr. et al. | |
| 4,671,431 | A | 6/1987 | Obrist | |
| 4,708,267 | A | 11/1987 | Sieverding et al. | |
| 4,874,117 | A | 10/1989 | Kay et al. | |
| 4,877,157 | A | 10/1989 | Saulle | |
| 4,880,326 | A | 11/1989 | Spivey et al. | |
| 4,906,120 | A | 3/1990 | Sekiguchi et al. | |
| 4,983,059 | A | 1/1991 | Holloway | |
| D317,253 | S | 6/1991 | Seager | |
| 5,025,960 | A | 6/1991 | Seager | |
| 5,567,073 | A | 10/1996 | Laforcade et al. | |
| 5,738,067 | A | 4/1998 | Landwehr et al. | |
| 5,839,626 | A | 11/1998 | Gross et al. | |
| 5,951,185 | A | 9/1999 | Kingsford et al. | |
| 6,027,272 | A | 2/2000 | Spencer et al. | |
| 6,068,421 | A | 5/2000 | Pierpoint | |
| 6,102,602 | A | 8/2000 | Kageyama et al. | |
| 6,142,692 | A | 11/2000 | Garcia | |
| 6,309,124 | B1 | 10/2001 | Gueret | |
| 6,332,561 | B1 | 12/2001 | Garcia et al. | |
| 6,419,124 | B1 * | 7/2002 | Hennemann | B05B 11/0038 222/321.6 |
| 6,758,374 | B2 | 7/2004 | Albisetti | |
| 6,923,589 | B2 | 8/2005 | Blackwell | |
| 7,040,830 | B2 | 5/2006 | Kliegman et al. | |
| D533,074 | S | 12/2006 | Mongeon | |
| 7,201,527 | B2 | 4/2007 | Thorpe et al. | |
| 7,419,323 | B1 | 9/2008 | Zhang | |
| 7,476,048 | B2 | 1/2009 | Prague | |
| 7,497,635 | B1 * | 3/2009 | Bae | A45D 34/04 401/188 R |
| 7,878,727 | B2 | 2/2011 | Koptis | |
| 7,959,369 | B2 | 6/2011 | Gueret | |
| 8,074,665 | B2 | 12/2011 | Pires et al. | |
| 8,161,983 | B1 | 4/2012 | Lee | |
| 8,499,970 | B2 | 8/2013 | Yoo | |
| 8,678,693 | B2 | 3/2014 | Sturgis et al. | |
| 8,714,857 | B1 | 5/2014 | Liu | |
| 8,752,543 | B2 * | 6/2014 | Davies | A61M 15/009 128/200.14 |
| 8,821,059 | B2 * | 9/2014 | Sasaki | A45D 33/02 401/132 |
| 8,839,803 | B2 | 9/2014 | Holloway | |
| 8,876,422 | B2 | 11/2014 | Lim | |
| 9,016,968 | B2 | 4/2015 | Thorpe | |
| 9,151,281 | B2 * | 10/2015 | Donnette | F04B 9/08 |
| 9,364,649 | B2 * | 6/2016 | Park | A61F 7/007 |
| 9,565,920 | B2 * | 2/2017 | Thorpe | A45D 34/04 |
| 2003/0231924 | A1 | 12/2003 | Libman et al. | |
| 2004/0120753 | A1 | 6/2004 | Gieux | |
| 2004/0222124 | A1 | 11/2004 | Byun | |
| 2006/0207627 | A1 | 9/2006 | Thorpe et al. | |
| 2006/0216104 | A1 | 9/2006 | Bouix et al. | |
| 2007/0014624 | A1 | 1/2007 | Fogelson et al. | |
| 2007/0186951 | A1 | 8/2007 | Gueret | |
| 2007/0205233 | A1 | 9/2007 | Petit et al. | |
| 2007/0206986 | A1 | 9/2007 | Gueret | |
| 2009/0097899 | A1 | 4/2009 | Carroll | |
| 2009/0261127 | A1 | 10/2009 | Pan | |
| 2010/0215422 | A1 | 8/2010 | Carroll et al. | |
| 2010/0224652 | A1 | 9/2010 | Lim | |
| 2012/0031925 | A1 | 2/2012 | Greenberg | |
| 2012/0267390 | A1 | 10/2012 | Jeong et al. | |
| 2012/0267398 | A1 | 10/2012 | Lim | |
| 2013/0017010 | A1 | 1/2013 | Liu | |
| 2013/0048658 | A1 | 2/2013 | Sawata | |
| 2013/0343798 | A1 | 12/2013 | Delage et al. | |
| 2014/0061243 | A1 | 3/2014 | Goettke | |
| 2014/0234010 | A1 | 8/2014 | Thorpe et al. | |
| 2014/0270897 | A1 | 9/2014 | Laurusonis | |
| 2015/0314311 | A1 | 11/2015 | Yoo et al. | |
| 2016/0007718 | A1 | 1/2016 | Villarreal et al. | |
| 2016/0324295 | A1 * | 11/2016 | Lee | A45D 34/041 |
| 2017/0144812 | A1 * | 5/2017 | Duquet | A45D 34/045 |

FOREIGN PATENT DOCUMENTS

| | | | | |
|---|---|---|---|---|
| CN | 200941885 | Y | 9/2007 | |
| EP | 181184 | A2 | 5/1986 | |
| FR | 925899 | A | 9/1947 | |
| FR | 2989290 | B1 | 5/2014 | |
| GB | 2404370 | B | 11/2005 | |
| JP | 05072756 | U | 10/1993 | |
| JP | 08238884 | A | 9/1996 | |
| JP | 2000254575 | A | 9/2000 | |
| JP | 2000279870 | A | 10/2000 | |
| JP | 2003135140 | A | 5/2003 | |
| JP | 3628037 | B2 | 3/2005 | |
| KR | 19970000120 | A | 1/1997 | |
| KR | 19980056332 | A | 9/1998 | |
| KR | 20020039098 | A | 5/2002 | |
| KR | 200388116 | Y1 | 6/2005 | |
| KR | 200433606 | Y1 | 12/2006 | |
| KR | 100781627 | B1 | 12/2007 | |
| KR | 1020090087074 | A | 8/2009 | |
| KR | 100935907 | B1 | 1/2010 | |
| KR | 2020140000428 | U | 1/2014 | |
| KR | 200471796 | Y1 | 3/2014 | |
| WO | 2012074162 | A1 | 6/2012 | |
| WO | WO-2012150729 | A1 * | 11/2012 | A45D 34/042 |
| WO | 2014130497 | A1 | 8/2014 | |
| WO | 2015147526 | A1 | 10/2015 | |

* cited by examiner

PULL DOWN PUMP ACTUATOR

CROSS REFERENCE TO RELATED APPLICATIONS

The present application claims the benefit of and priority to U.S. Provisional Patent Application Ser. No. 62/365,502, filed on Jul. 22, 2016, titled PULL DOWN PUMP ACTUATOR, the disclosure of which is incorporated herein by reference.

TECHNICAL FIELD

The present disclosure relates generally to a cosmetic applicator which has a pump for dispensing cosmetic product.

SUMMARY

According to one example of the present disclosure, a device for dispensing and applying a cosmetic product includes a container configured to hold a volume of cosmetic product, the container having a closed end at a lower end of the device and an open end facing an upper end of the device, and a cosmetic dispensing system coupled to the open end of the container and comprising a tip having an outlet for dispensing cosmetic product, and an actuator configured to be manually depressed to deliver a portion of the volume of cosmetic product to the outlet, wherein the actuator includes finger guides on opposite sides of the actuator, the finger guides disposed below the tip and providing opposing surfaces for depressing the actuator, moving the actuator towards the lower end of the device.

Alternatively or additionally, in another example, the finger guides include two or more depressions in an outer surface of the actuator.

Alternatively or additionally, in another example, the two or more depressions each include one or more raised ridges disposed on a lower portion of the depression.

Alternatively or additionally, in another example, the outlet is disposed adjacent an upper surface of the tip, the upper surface of the tip defining the upper surface of the device.

Alternatively or additionally, in another example, the upper surface of the tip is angled.

Alternatively or additionally, in another example, the upper surface of the tip is a rigid material.

Alternatively or additionally, in another example, the upper surface of the tip is flexible.

Alternatively or additionally, in another example, the tip includes a brush.

Alternatively or additionally, in another example, the device further comprises a sponge disposed over the outlet.

Alternatively or additionally, in another example, the actuator includes a separate insert disposed therein defining the outlet, wherein the sponge includes a sheet disposed over the outlet and fixed between an inner surface of the actuator and an outer surface of the insert.

Alternatively or additionally, in another example, the device further comprises a pump assembly configured to move the cosmetic product from the container through the outlet when the actuator is depressed.

Alternatively or additionally, in another example, the pump assembly is an airless pump.

In another example, a device for dispensing and applying a cosmetic product comprises a container configured to hold a volume of cosmetic product, and a cosmetic dispensing system coupled to an open upper end of the container and comprising a pump assembly disposed within an open upper end of the container, an actuator connected to the pump assembly, and a tip connected to the actuator and having an outlet for dispensing cosmetic product, the tip defining an upper surface of the device, wherein the actuator is configured to be manually depressed to deliver a portion of the volume of cosmetic product to the outlet, wherein the actuator includes a depression disposed below the tip providing one of more surfaces for manually depressing the actuator, thereby moving the actuator towards the container, activating the pump assembly, and expelling the portion of cosmetic product from the outlet.

Alternatively or additionally, in another example, the depression extends around a circumference of the actuator.

Alternatively or additionally, in another example, the depression includes two depressions defining finger guides on opposite sides of the actuator.

Alternatively or additionally, in another example, the two depressions each include one or more raised ridges disposed on a lower portion of the depression.

BRIEF DESCRIPTION OF THE DRAWINGS

The foregoing and other aspects of the present disclosure are best understood from the following detailed description when read in connection with the accompanying drawings. In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present disclosure relates generally to a device which dispenses a cosmetic product. This technology is particularly well-suited for, but by no means limited to, liquid cosmetic products such as concealer, foundation, lotion, or serum.

Figure 1A:
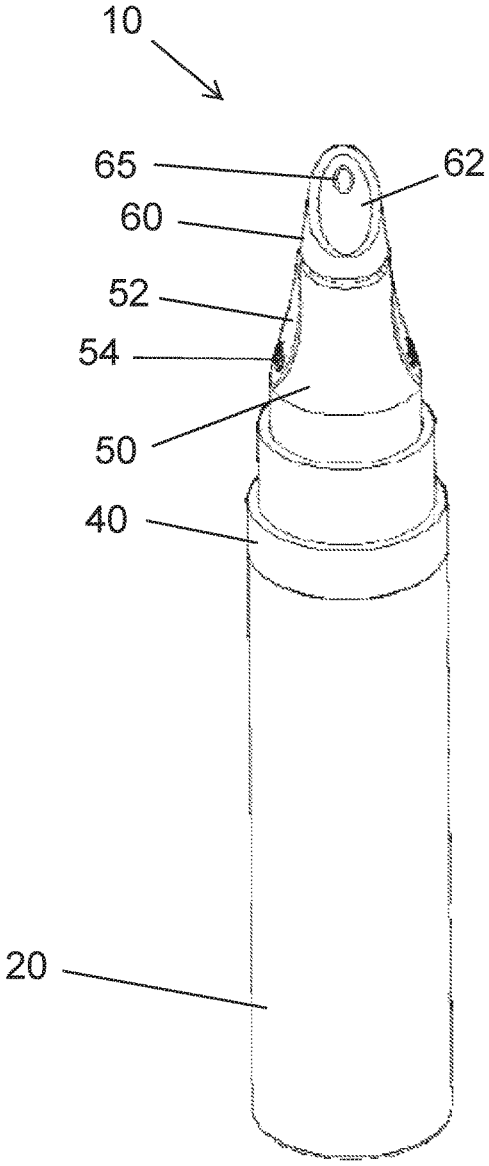
FIG. 1A is a perspective view of a device for dispensing and applying a cosmetic product with a tip according to one example.
Figure 1B:
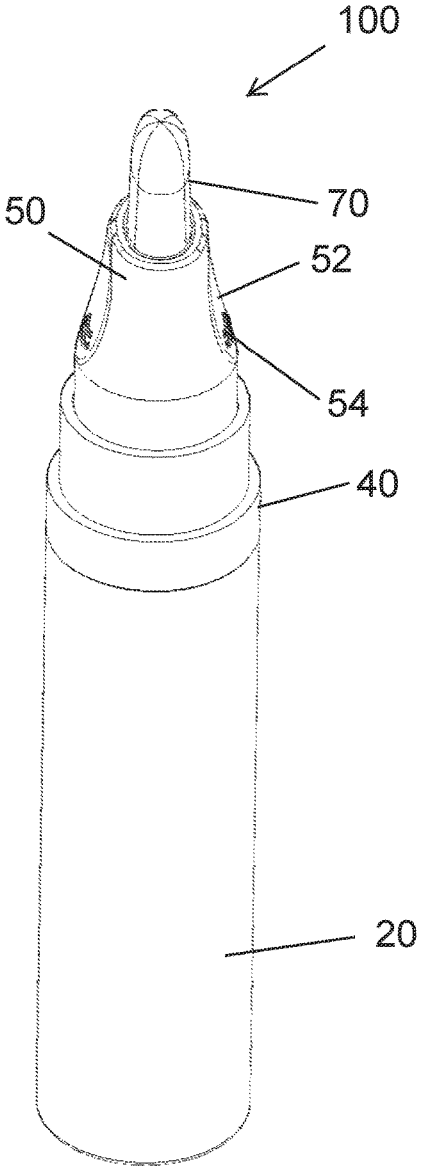
FIG. 1B is a perspective view of a device for dispensing and applying a cosmetic product with a tip according to another example.

FIGS. 1A and 1B illustrate a device 10, 100 for dispensing and applying a cosmetic product with alternative tips 60, 70. The device 10 includes a bottle or container 20 for holding the cosmetic product. The container 20 may include a separate internal reservoir (not shown). A collar 40 is disposed over the upper end of the container 20, connecting an actuator 50 to the container 20. The tip 60, 70 is connected to the actuator 50 and defines the upper surface of the device. An angled tip 60 having an angled surface 62 and a product outlet 65 is illustrated in FIG. 1A. In some examples, the angled tip 60, and in particular, the angled surface 62 may be made of a material capable of holding and retaining a thermal charge. In one example, the tip 60 can be made of stainless steel. In other examples, any suitable material may be used that is capable of retaining heat or cold during the application of the product. Examples of other suitable materials include, without limitation, metals (e.g., aluminum, titanium, steel, nickel, tin, copper, brass, alloys thereof, etc.), ceramics, stone, high density plastics, composites, or the like. In still further examples, the tip 60 is not made of material capable of holding and retaining a thermal charge. Examples of such materials include rigid or flexible materials such as plastics, silicone, fabric, sponge, etc.

Figure 4:
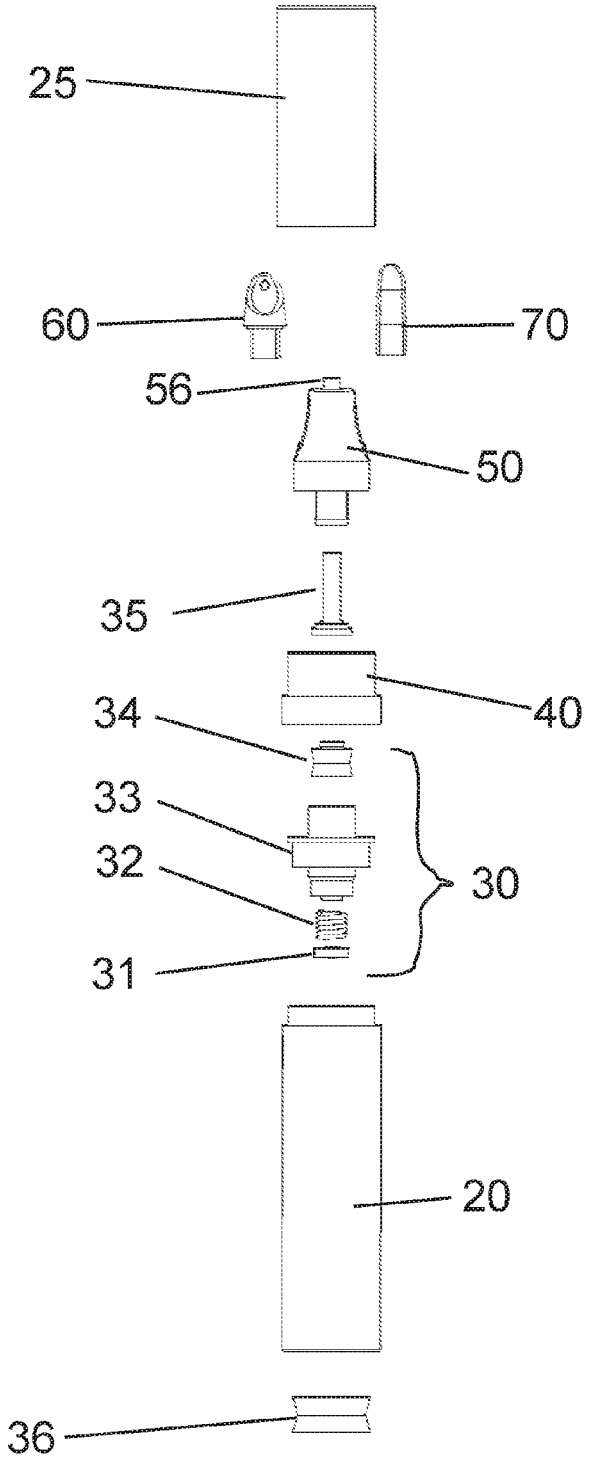
FIG. 4 is an exploded view of the device of FIGS. 1A and 1B showing the alternative tips.

A brush tip 70 including a shaped brush is illustrated in FIG. 1B. The outlet in FIG. 1B is disposed at a base of the brush, adjacent the upper surface of the actuator 50. A cap 25, shown in FIG. 4, is provided to cover the tip when the device is not in use. The cap 25 may engage the collar 40 with a snap fit, threaded connection, friction fit, or any other suitable connection.

The device 10, 100 for dispensing and applying a cosmetic product is shown in an elongated cylindrical configuration. However, it should be understood that examples of the disclosure described herein may be applied to various other configurations in other examples. For example, the device 10, 100 may alternatively be embodied in an elongated cubical configuration where the components of the device are all cubical in shape. Other shapes include oval, triangular, heart shaped, etc.

The actuator 50 may include one or more finger guides or depressions 52 allowing the user to grip the actuator and push down on the actuator 50 to dispense the product. The depressions 52 are disposed below the tip 60, 70, allowing the user to grip and dispense the product without touching the tip 60, 70. One or more raised ridges 54 may be provided at the base of the depressions 52, providing additional gripping surfaces. The actuator 50 and depressions 52 are configured to allow a downward force to be applied to the device below the tip 60, 70. The device is configured to be operated in an upright orientation, as shown in FIGS. 1A and 1B. The configuration of the device 10, 100 differs from devices in which the dispensing surface must be pushed down to expel product, often with the body part receiving the product being used to apply pressure to the dispensing surface. The configuration of the actuator 50 and depressions 52 allows the user to dispense the cosmetic product without applying force to the tip 60 and angled surface 62 or brush 70, and without having to apply pressure to the device with the body part to which the product is applied. This may provide a more controlled application of product and avoid applying pressure to the body part receiving the product, which may be the face. Using the fingers to apply downward force to the actuator 50 may provide a more comfortable product delivery.

Figure 2:
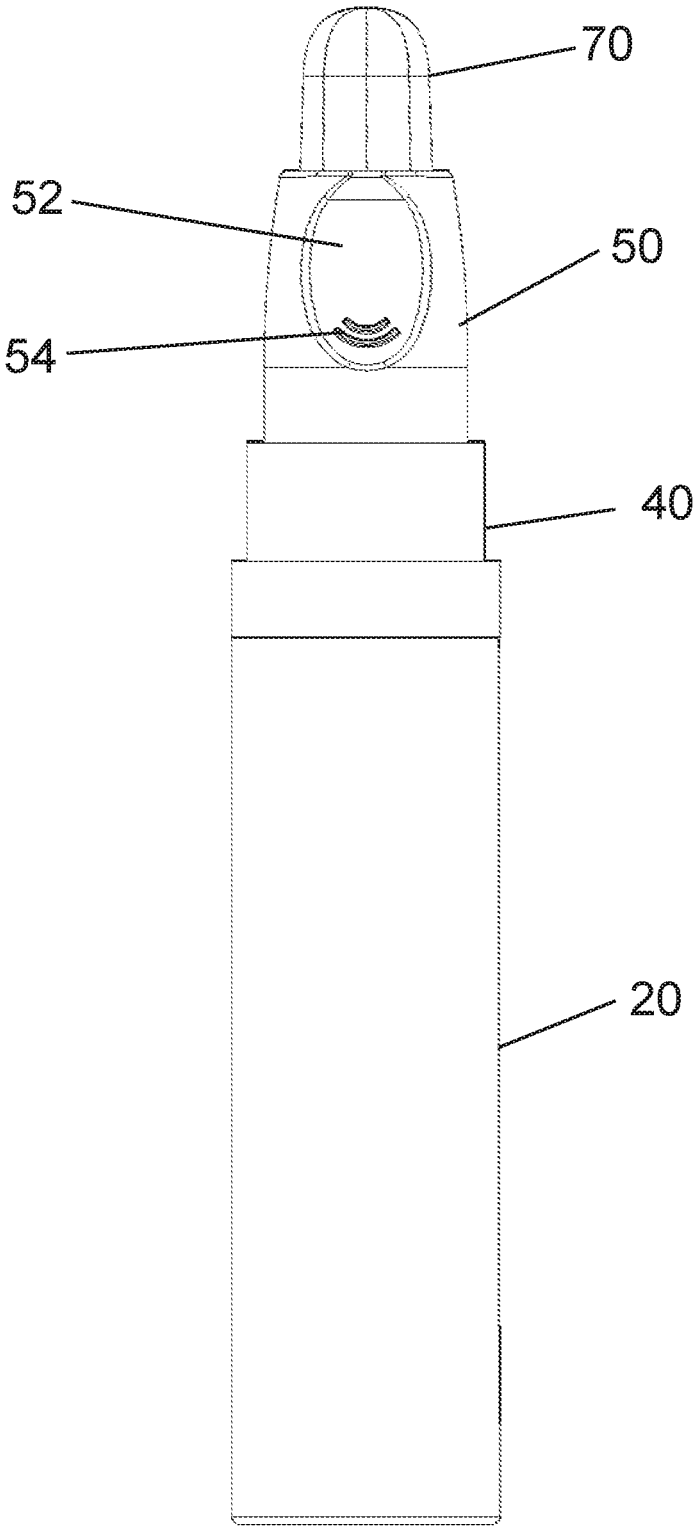
FIG. 2 is a side view of the device of FIG. 1B.

FIG. 2 shows the device of FIG. 1B in a side profile, illustrating an example size and configuration of depressions 52 on the actuator 50. The depressions 52 may include finger guides shaped to comfortably receive the user's fingers on opposite sides of the actuator 50. the depressions 52 may include two depressions as shown in FIGS. 1A and 1B, or four depressions may be present, with two sets of opposing depressions allowing for two different orientations for the user to hold and dispense product. As shown in FIG. 2, one or more ridges 54 may be disposed near the base of the depressions 52. The ridges 54 may provide additional gripping structures for the user's fingers. The ridges 54 may be raised portions of the actuator surface or the ridges 54 may be added elements attached to the depressions. In one example, the ridges 54 may be made of a different material than the actuator 50, such as rubber, silicone, or another material that provides an enhanced gripping surface.

Figure 3:
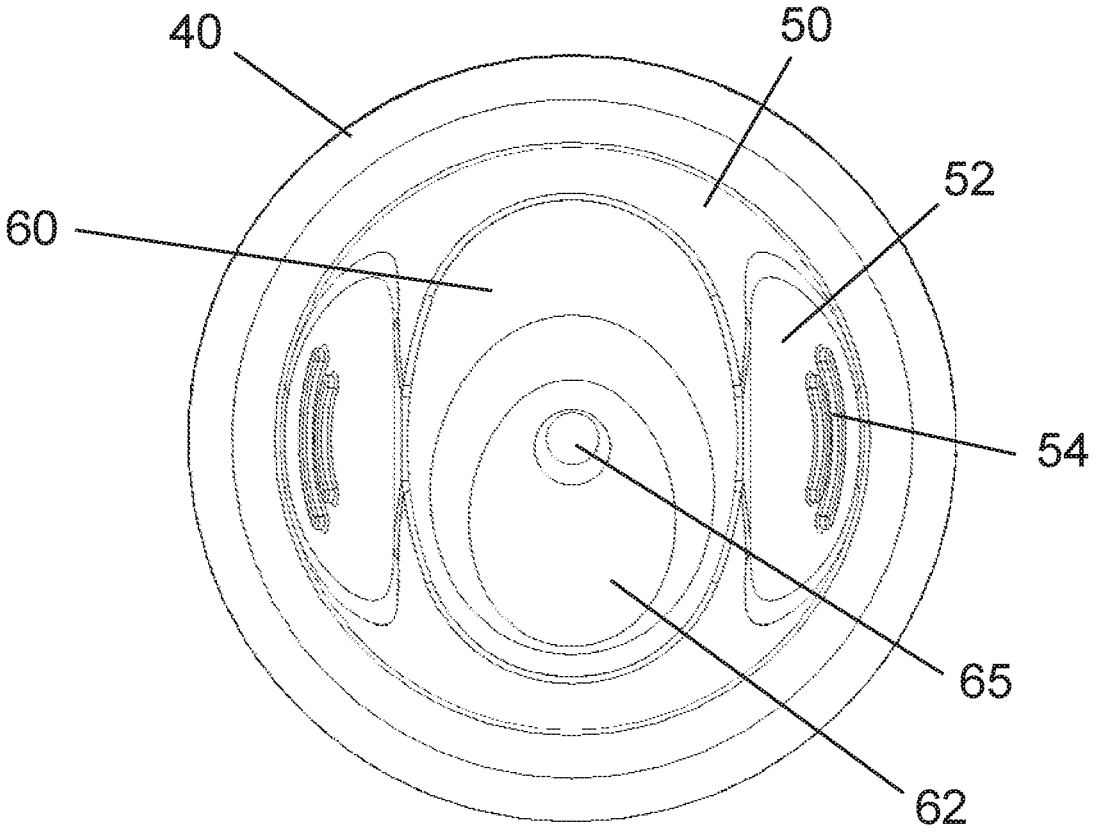
FIG. 3 is a top view of the device of FIG. 1A.

The top-down illustration in FIG. 3, of the device shown in FIG. 1A, shows the orientation of opposing depressions 52 relative to the product outlet 65 and the angled tip surface 62. The opposing depressions 52 allow for an even application of downward force to the actuator, resulting in an even flow of product. The user may dispense product by grasping the body or container 20 in one hand with the index and middle fingers resting on the opposing depressions 52. The index and middle fingers are pulled downward to move the actuator 50 towards the container 20, thereby dispensing product from the outlet 65.

Figure 5:
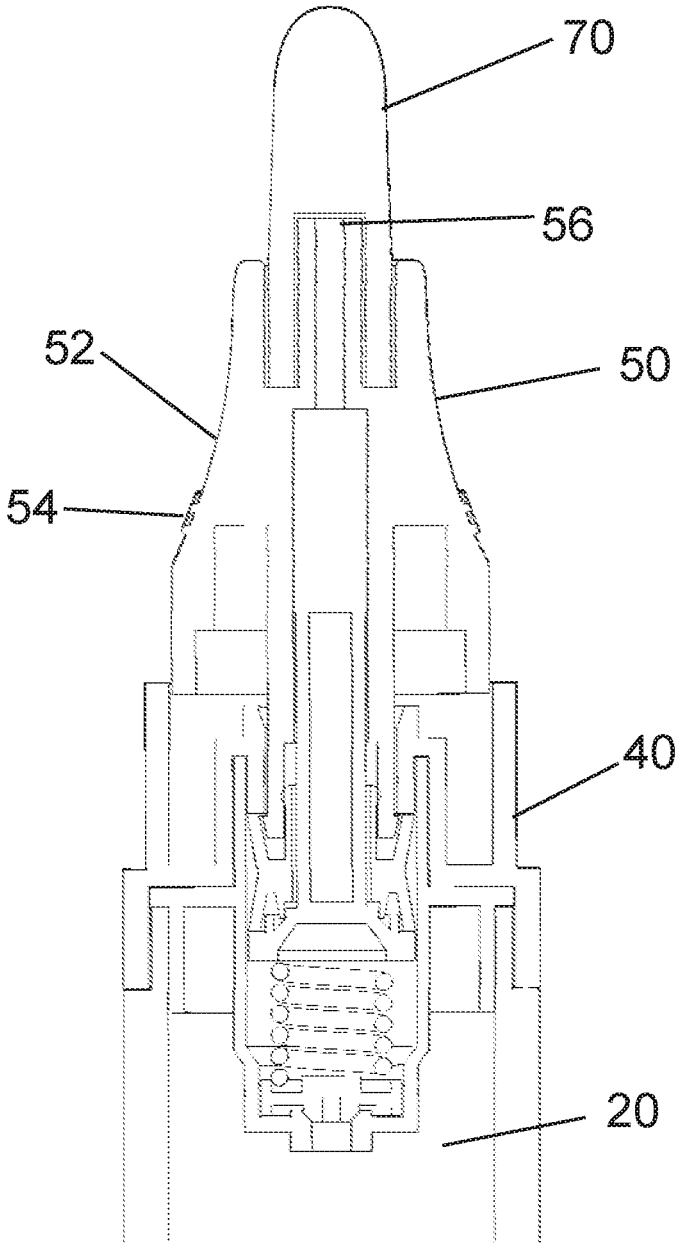
FIG. 5 is a cross-sectional view of the device of FIG. 1B.

A pump assembly 30 is disposed at the upper open end of the container 20, as seen in FIG. 4. The pump assembly 30 may include a valve 31, a spring 32, a pump housing 33, a piston 34, and a piston base 35 including a product delivery passageway connected to the outlet 56 of the actuator, which may be connected to the product outlet 65 on the angled tip 60. A piston 36 is disposed at the bottom end of the container 20 and pushes the product upward as the actuator 50 is depressed and then released, actuating the pump assembly 30. In the device 100 with a brush tip 70, the outlet 56 of the actuator is disposed at the base of the brush tip 70, as seen in the cross-sectional view of FIG. 5.

Activation of the pump assembly 30 removes a portion of the cosmetic product from the container 20 via a vacuum effect and dispenses that portion through an outlet 56 in the actuator 50. The technique used for activating the pump assembly 30 includes depressing the depressions 52 on the actuator 50 in a direction towards the container 20. This causes the pump assembly 30 to be lowered, and as the pump assembly 30 is lowered, a vacuum effect is created and product is dispensed through the outlet 56.

In some embodiments, the pump assembly 30 is part of an airless pump system. For example, in an example where an airless pump is used, a small piston 36 sits on the bottom of the cosmetic product inside the container 20. When the pump assembly 30 is activated, the piston pushes the material to the top of the container as the vacuum effect pulls the piston upwards. A small hole (not shown) may be provided in the bottom of the container 20 to allow for air to fill the space beneath the piston as cosmetic product is removed. In other examples where an airless pump is used, the container 20 includes an elastically deformable diaphragm (not shown) which acts to push product out of the container 20 and through the pump assembly 30. Various types of materials may be used for constructing the container 20 including, for example, plastic-based materials and glass. The top portion of the container 20 may include various features which allow it to be affixed with the pump assembly 30. In some embodiments, these features are designed to allow the pump assembly 30 to be removed by an end user, allowing the container 20 to be refilled with additional cosmetic product. For example, a screw-type mechanism may be used, with the top portion of the container 20 including threads on its exterior portion designed to be received by threads on the interior of the pump assembly 30.

Figure 6:
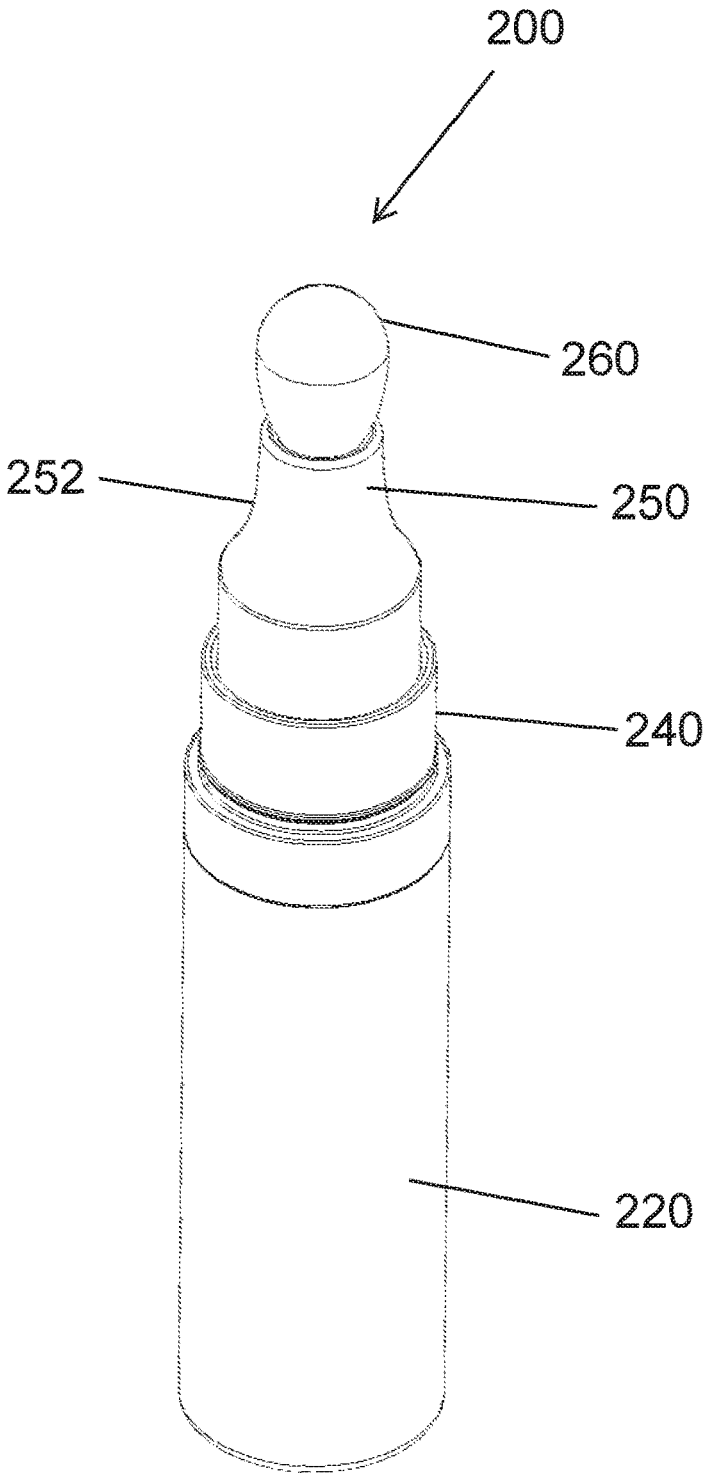
FIG. 6 is a perspective view of a device for dispensing and applying a cosmetic product according to another example.
Figure 7:
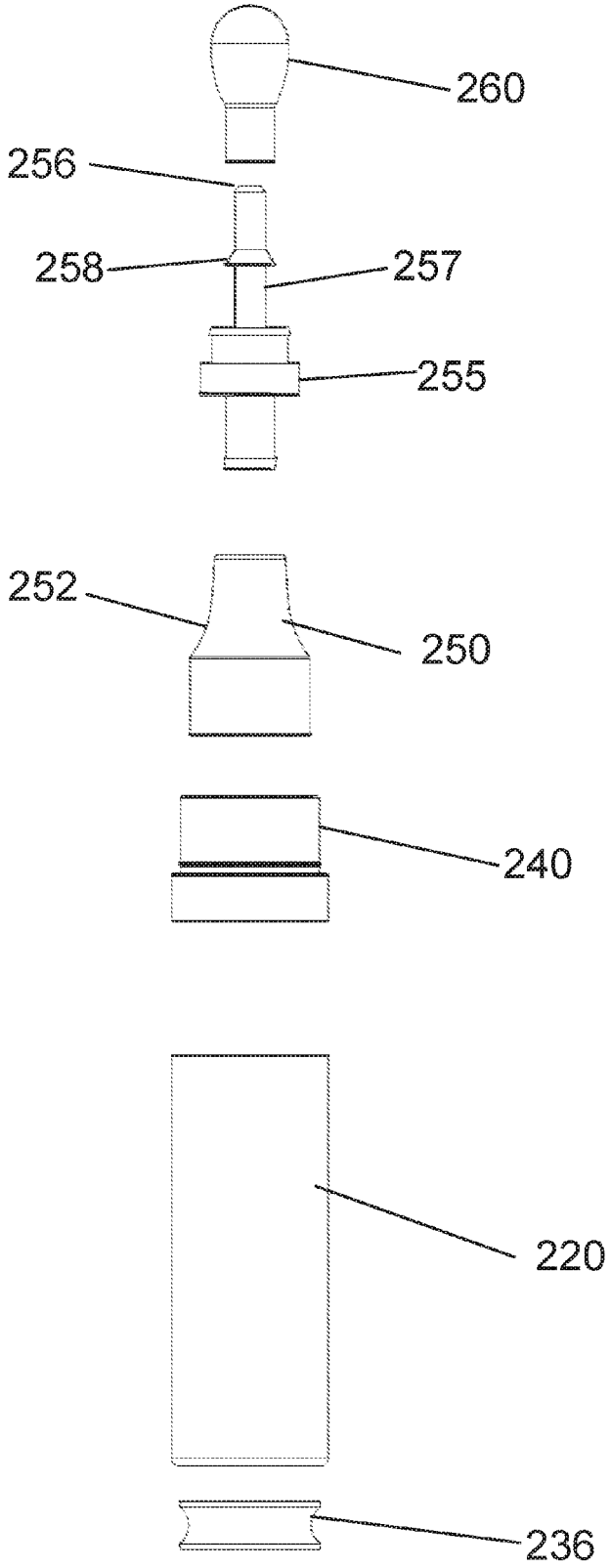
FIG. 7 is an exploded view of the device of FIG. 6.
Figure 8:
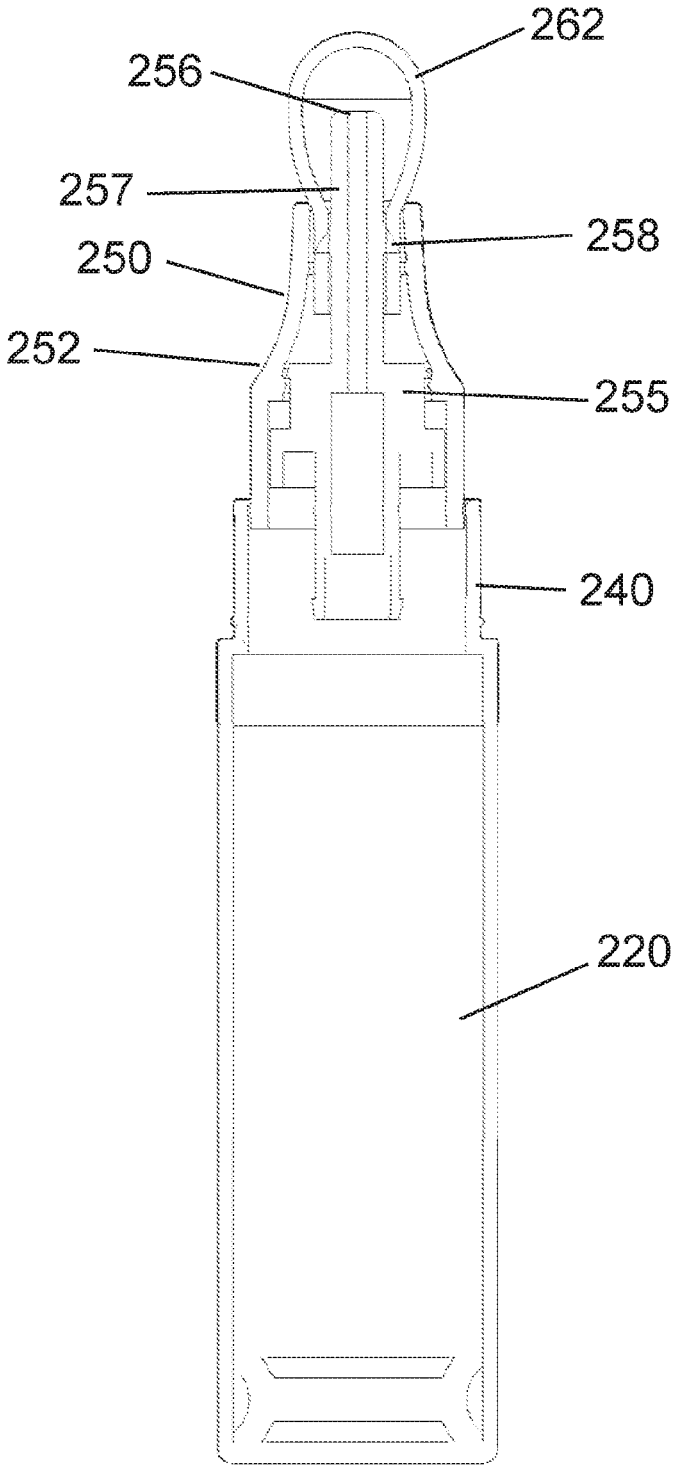
FIG. 8 is a cross-sectional view of the device of FIG. 6.

Another example of a device 200 for dispensing and applying a cosmetic product is shown in FIGS. 6-8. The device 200 has a container 220 and collar 240 similar to the devices 10, 100 described above. The device 200 may include the same pump assembly as described above for devices 10, 100. The actuator 250 of device 200 is shown with a single depression 252 forming a circumferential surface acting as a finger guide. See FIG. 6. The device 200 may be held in any orientation and the user applies a downward force on the depression 252, thereby moving the actuator 250 towards the container 220, which activates a pump assembly contained within the collar 240 and container 220. The device 200 has an applicator tip 260 which may be bulbous in shape. The device 200 may include an actuator 250 and a separate insert 255, as shown in FIGS. 7 and 8. The insert 255 may include a product delivery tube 257 with an outlet 256 at the top end. Having the actuator 250 and insert 255 as two separate pieces allows the applicator, which may be a sheet 262, to be disposed over the outlet 256 and fixed between the inner surface of the actuator 250 and the outer surface of the product delivery tube 257. In some examples, the product delivery tube 257 may include one or more protrusions, bumps or barbs 258 that aid in retaining the applicator sheet 262 within the actuator 250.

In some examples, such as that illustrated in FIGS. 6-8, the applicator tip 260 may be a sponge with a rounded end. In other examples, the applicator tip 260 may have an alternate shape. These alternate shapes may include, without limitation, pointed, oval, square, rectangular, teardrop, or wedge-shaped sponges. The applicator tip 260 may be made of various materials including, without limitation, foam, latex, rubbers, silicon, metal, ceramic, plastic, and/or natural sponge materials.

Each of the above non-limiting examples can stand on its own, or the elements from each example may be combined in various permutations or combinations with one or more elements of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A device for dispensing and applying a cosmetic product, the device comprising:

a container configured to hold a volume of cosmetic product, the container having a closed end at a lower end of the device and an open end facing an upper end of the device; and a cosmetic dispensing system coupled to the open end of the container and comprising:

a tip having an outlet for dispensing cosmetic product; and an actuator configured to be manually depressed to deliver a portion of the volume of cosmetic product to the outlet, wherein the actuator includes finger guides on opposite sides of the actuator, the finger guides disposed below the tip and providing opposing surfaces for depressing the actuator to move the actuator towards the lower end of the device; and wherein the finger guides each extend generally parallel to a longitudinal axis of the cosmetic dispensing system.

2. The device of claim 1, wherein the finger guides include two or more depressions in an outer surface of the actuator.

3. The device of claim 2, wherein the two or more depressions each include one or more raised ridges disposed on a lower portion of the depression.

4. The device of claim 1, wherein the outlet is disposed adjacent an upper surface of the tip, the upper surface of the tip defining the upper surface of the device.

5. The device of claim 4, wherein the upper surface of the tip is angled.

6. The device of claim 5, wherein the upper surface of the tip is a rigid material.

7. The device of claim 5, wherein the upper surface of the tip is flexible.

8. The device of claim 4, wherein the tip includes a brush.

9. The device of claim 4, further comprising a sponge disposed over the outlet.

10. The device of claim 9, wherein the actuator includes a separate insert disposed therein defining the outlet, wherein the sponge includes a sheet disposed over the outlet and fixed between an inner surface of the actuator and an outer surface of the insert.

11. The device of claim 1, further comprising a pump assembly configured to move the cosmetic product from the container through the outlet when the actuator is depressed.

12. The device of claim 11, wherein the pump assembly is an airless pump.

13. A device for dispensing and applying a cosmetic product, the device comprising:

a container configured to hold a volume of cosmetic product, the container having an open end; and a cosmetic dispensing system coupled to the open upper end of the container and comprising:

a pump assembly disposed within an open upper end of the container;

an actuator connected to the pump assembly; and a tip connected to the actuator and having an outlet for dispensing cosmetic product, the tip defining an upper surface of the device;

wherein the actuator is configured to be manually depressed to deliver a portion of the volume of cosmetic product to the outlet, wherein the actuator includes a depression disposed below the tip providing one of more surfaces for manually depressing the actuator, thereby moving the actuator towards the container, activating the pump assembly, and expelling the portion of cosmetic product from the outlet; and wherein the one or more surfaces for manually depressing the actuator each extend generally parallel to a longitudinal axis of the cosmetic dispensing system.

14. The device of claim 13, wherein the depression extends around a circumference of the actuator.

15. The device of claim 13, wherein the depression includes two depressions defining finger guides on opposite sides of the actuator.

16. The device of claim 15, wherein the two depressions each include one or more raised ridges disposed on a lower portion of the depression.

17. The device of claim 13, wherein the cosmetic dispensing system comprises a collar having a first end disposed over and at least partly surrounding the upper end of the container, and a second end sized to receive the actuator such that when the actuator is depressed, it moves within the collar.

18. The device of claim 1 wherein the cosmetic dispensing system comprises a collar having a first end disposed over and at least partly surrounding the upper end of the container, and a second end sized to receive the actuator such that when the actuator is depressed, it moves within the collar.

* * * * *